US008695567B2

(12) United States Patent
Javaherian et al.

(10) Patent No.: US 8,695,567 B2
(45) Date of Patent: Apr. 15, 2014

(54) METHOD AND APPARATUS FOR ESTIMATING ENGINE OPERATING PARAMETERS

(75) Inventors: Hossein Javaherian, Rochester Hills, MI (US); Alan W. Brown, Canton, MI (US); Michael P. Nolan, Warren, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 565 days.

(21) Appl. No.: 12/915,174

(22) Filed: Oct. 29, 2010

(65) Prior Publication Data

US 2012/0103307 A1 May 3, 2012

(51) Int. Cl.
*F02M 7/00* (2006.01)

(52) U.S. Cl.
USPC ..... 123/436; 123/435; 123/494; 701/111; 701/115

(58) Field of Classification Search
USPC ..... 123/435–436, 494; 701/106, 111, 115; 702/41; 73/114.02–114.11
See application file for complete search history.

(56) References Cited

U.S. PATENT DOCUMENTS 6,029,109 A * 2/2000 Rossignol et al. ..... 701/110
6,360,726 B1 * 3/2002 Javaherian ..... 123/491
6,425,373 B1 * 7/2002 Robichaux et al. ..... 123/436
6,668,812 B2 * 12/2003 Javaherian ..... 123/673
6,694,960 B2 * 2/2004 Hess et al. ..... 123/673
7,027,910 B1 * 4/2006 Javaherian et al. ..... 701/111
7,246,594 B2 * 7/2007 Hartmann ..... 123/198 F
7,377,260 B2 * 5/2008 Jehle et al. ..... 123/406.2
7,520,179 B2 * 4/2009 Bernstein et al. ..... 73/801
2003/0216853 A1 * 11/2003 Jacobson ..... 701/106
2005/0205063 A1 * 9/2005 Kolmanovsky et al. ..... 123/436
2006/0064232 A1 * 3/2006 Ampunan et al. ..... 701/115
2008/0060861 A1 * 3/2008 Baur et al. ..... 180/65.6

FOREIGN PATENT DOCUMENTS

DE 10140376 A1 8/2000

OTHER PUBLICATIONS

Grunbacher,E., Estimation of the Mean Value Engine Torque Using an Extended Kalman Filter; SAE 2005-01-0063; 2005 SAE World Congress; Apr. 2005.
Schagerberg,S.; Instantaneous Crankshaft Torque Measurements—Modeling and Validation; SAE 2003-01-0713; 2003 SAE World Congress; Mar. 2005.

* cited by examiner

*Primary Examiner* — Stephen K Cronin
*Assistant Examiner* — Joseph Dallo

(57) ABSTRACT

A method for operating an internal combustion engine includes monitoring signal output from a high-resolution torque sensor configured to monitor engine torque during ongoing operation, monitoring states of engine operating and control parameters associated with engine input parameters, and estimating a mass air charge for each cylinder event corresponding to the signal output from the high-resolution torque sensor and the states of engine operating and control parameters associated with the engine input parameters.

11 Claims, 2 Drawing Sheets

METHOD AND APPARATUS FOR ESTIMATING ENGINE OPERATING PARAMETERS

TECHNICAL FIELD

This disclosure is related to control of internal combustion engines.

BACKGROUND

The statements in this section merely provide background information related to the present disclosure and may not constitute prior art.

Known engine operation includes delivering fuel and air to combustion chambers, igniting the corresponding mixture, and transferring pressure generated by the ignited mixture to a crankshaft via a moveable piston. Engine control parameters include fuel mass and injection timing, spark ignition timing in spark ignition engines, phasing, magnitude and duration of engine valve opening and closing, residual gas fraction, and others. Known engine control schemes include monitoring engine operation and controlling engine control parameters to achieve preferred targets for in-cylinder pressure, engine torque, specific fuel consumption, and emissions while responding to operator demands. One known engine control scheme includes monitoring engine operation to determine a mass of intake air into a cylinder, referred to as a cylinder air charge, and controlling engine operating parameters including fueling and spark timing in response thereto to achieve preferred targets for the engine operating parameters.

Monitoring engine operation includes monitoring engine operating states that may be used to calculate, estimate or otherwise determine states of engine operating parameters including, e.g., in-cylinder pressure, engine torque, specific fuel consumption, and air/fuel ratio.

In-cylinder pressure sensors coupled to signal processing devices are used during ongoing engine operation to monitor in-cylinder pressures for individual cylinders. Known engine control schemes use the monitored in-cylinder pressures for individual cylinders to control engine control parameters including, e.g., spark timing, fuel injection timing, and EGR mass flowrate.

SUMMARY

A method for operating an internal combustion engine includes monitoring signal output from a high-resolution torque sensor configured to monitor engine torque during ongoing operation, monitoring states of engine operating and control parameters associated with engine input parameters, and estimating a mass air charge for each cylinder event corresponding to the signal output from the high-resolution torque sensor and the states of engine operating and control parameters associated with the engine input parameters.

BRIEF DESCRIPTION OF THE DRAWINGS

One or more embodiments will now be described, by way of example, with reference to the accompanying drawings, in which.

DETAILED DESCRIPTION

Figure 1:
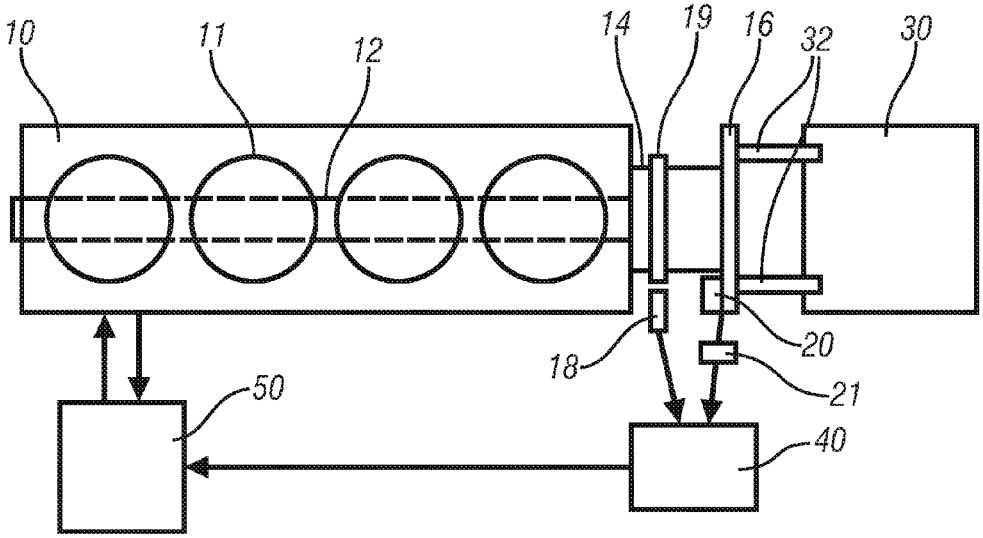
FIG. 1 is a schematic diagram of a multi-cylinder internal combustion engine including an engine output member coupled to a gearbox of a transmission and including a torque sensor, in accordance with the present disclosure.

Referring now to the drawings, wherein the depictions are for the purpose of illustrating embodiments only and not for the purpose of limiting the same, FIG. 1 schematically illustrates a multi-cylinder internal combustion engine 10 constructed in accordance with an embodiment of the disclosure. The exemplary engine 10 has reciprocating pistons movable in cylinders which define variable volume combustion chambers 11. The reciprocating pistons couple to a crankshaft 12. The crankshaft 12 couples to an engine output member 14 that preferably couples via a flexplate 16 to a gearbox 30 of a transmission and a driveline to transfer engine torque thereto in response to an operator torque request. Engine torque is transferred to the gearbox 30 of the transmission via the flexplate 16. In one embodiment the flexplate 16 couples to an input element of an automatic transmission, e.g., a torque converter. Alternatively, the flexplate 16 may couple or be an element of a clutch component in a manual transmission, or may couple to an input element a hybrid transmission.

The engine 10 includes sensing devices configured to monitor states of engine operating parameters associated with engine operation and actuators that are configured to control states of engine control parameters for different areas of engine operation. The sensing devices and actuators are signally and operatively connected to a control module 50. It is appreciated that the engine 10 may employ a four-stroke operation wherein each engine combustion cycle includes 720 degrees of angular rotation of the crankshaft 12 divided into repetitively occurring combustion cycles including intake-compression-expansion-exhaust. It is appreciated that the engine 10 may operate in one of various combustion cycles, including four-stroke combustion cycles, two-stroke combustion cycles and six-stroke combustion cycles. It is appreciated that the engine 10 may include an engine configured to operate in one or more engine combustion modes including, e.g., spark-ignition, compression-ignition, controlled auto-ignition (i.e., homogeneous-charge compression ignition), and premixed charge compression ignition. It is appreciated that the transmission may include one of a rear-wheel drive transmission, a transaxle, or other torque transmitting devices associated with operation of a powertrain and vehicle. It is appreciated that the engine may be configured to effect variable opening and closing of engine valves, including either or both of a variable cam phasing system and a variable valve lift system, and other systems including turbocharged or camless engines.

The sensing devices include a crankshaft position sensor 18 and associated crank wheel 19 configured to monitor a rotational angle $\Theta$ of the crankshaft 12, from which the control module 50 determines crank angle and rotational speed (N) of the crankshaft 12, and position of each piston and associated combustion stroke. In one embodiment, the crank wheel 19 includes a 360 X wheel corresponding to 360° of rotation of the crankshaft 12 which may be monitored by the crankshaft position sensor 18. It is appreciated that crankshaft encoder devices and other rotational position sensing devices may be employed to achieve similar measurement results. When the crank wheel 19 includes a 360 X wheel, combustion sensing including engine torque sensing may be associated with each degree of crankshaft rotation in a discretized manner. It is appreciated that a low resolution crankshaft position sensor may similarly be used with enhanced torque resolution techniques.

The engine 10 is configured to monitor engine load. It is appreciated that engine load is an engine operating parameter that may be measured directly using a sensing device or inferred from related inputs. In one embodiment, engine load may be determined using a manifold absolute pressure (MAP) sensor. In one embodiment, engine load may be determined using an accelerator pedal sensor. In one embodiment, engine load may be determined using an engine airflow sensor. In one embodiment, engine load may be inferred based upon engine fuel flow. An engine operating point may be determined that corresponds to the rotational speed (N) of the crankshaft 12 and the engine load. Other engine sensing devices preferably include an air/fuel ratio sensor.

The engine 10 includes a torque sensor 20 configured to measure engine torque transferred between the engine 10 and the gearbox 30 of the transmission via the flexplate 16 by monitoring deformation within the flexplate 16. Alternatively, the torque sensor 20 may be installed in another location, e.g., mounted directly onto the crankshaft 12. A single torque sensor 20 may be used. Alternatively a plurality of torque sensors 20 may be used. The crankshaft 12 is preferably coaxial with and rigidly coupled to the flexplate 16 to rotate therewith. The flexplate 16 is preferably coupled to the gearbox 30 near an outer rim using a plurality of fasteners 32, allowing the engine 10 to transfer engine torque to drive the gearbox 30 through the flexplate 16. The term "engine torque," as used herein, refers to any turning moment acting upon the crankshaft 12 of the engine 10. The term "flexplate" includes any element used to transfer engine torque within a powertrain, including, e.g., a flexplate and a flywheel. In one embodiment, the engine load is directly measured using the torque sensor 20.

The torque sensor 20 measures the engine torque transferred between the engine 10 and the gearbox 30 through the flexplate 16 by quantifying deformations (e.g., negative and positive strain) in the flexplate 16. This includes quantifying a strain field of the flexplate 16, such as a change in a circumferential reference length, stress and strain, or a speed of wave propagation that may be measured using a surface acoustic wave-based torque sensor (SAW). It is understood that true strain exhibited by the flexplate 16 is directly proportional to the experienced stresses, the unit cross-sectional area, and the modulus of elasticity of the material of the flexplate 16, requiring the torque sensor 20 and associated signal processing hardware and algorithms to be configured for specific parameters of the flexplate 16. In one embodiment, a finite element stress analysis of the flexplate 16 under anticipated engine torque conditions is performed to identify an optimal stress point on the flexplate 16, indicating one or more preferred locations for affixing one or more sensing elements of the torque sensor 20.

The torque sensor 20 is fixedly attached to the flexplate 16, and preferably has a signal output that changes in relation to strain in the flexplate 16. The sensing elements of the torque sensor 20 are preferably attached to the engine-side face of the flexplate 16, and may be welded, bolted and/or bonded to the flexplate 16 using a suitable high-temperature epoxy. The sensing elements of the torque sensor 20 preferably use one of a plurality of suitable technologies, such as an optical, magnetic, piezoelectric, magnetoelastic, or a resistance based technology to measure the strain, displacement, stress or speed of wave propagation. For example, the sensing elements may include at least one strain gauge device used to measure strain by changing resistance in response to linear deformation associated with strain in the flexplate 16. More preferably, the strain gauge is also thermally compensated to minimize the effect of temperature variations, given the wide range of temperatures anticipated to be experienced by the flexplate 16.

In one embodiment the torque sensor 20 includes a high-resolution wireless quartz-based sensor using surface acoustic wave resonator (SAW) technology that includes an array including a plurality of reflecting metal strips fixedly attached to the flexplate 16. An interrogation pulse is communicated from a stationary source 21 that signally couples to the torque sensor 20 to cause excitation thereof. The reflecting metal strips resonate in response to the excitation caused by the interrogation pulse, with the resonating response monitored by the stationary source 21. Strain present in the flexplate 16 at the location of the torque sensor 20 affects a propagation path and surface wave velocity of the excitation, thus affecting the resonance frequency of the resonating response. Preferably, the high-resolution wireless quartz-based sensor has an operating bandwidth of 3 to 50 kHz.

The stationary source 21 for the torque sensor 20 and the crankshaft position sensor 18 are signally connected to a digital signal processing circuit 40, which may include a microcontroller, a digital signal processing (DSP) circuit and/or an application-specific integrated circuit (ASIC). The stationary source 21 communicates the resonating response output from the torque sensor 20 to the digital signal processing circuit 40. The digital signal processing circuit 40 is configured to account for specific parameters of the flexplate 16, including the aforementioned anticipated stresses, the unit cross-sectional area, and the modulus of elasticity of the material of the flexplate 16. The digital signal processing circuit 40 generates a signal output that is preferably directly proportional to the true strain experienced by the flexplate 16. It is appreciated that the digital signal processing circuit 40 is configured to monitor signals generated by the torque sensor 20 and the crankshaft position sensor 18 and generate output signals corresponding to the engine torque that are discretized to specific rotational angles of the crankshaft 12.

A representative version of the engine 10 may be equipped with the torque sensor 20 during a calibration exercise to derive coefficients for a first linear function $F_l$ for estimating a magnitude of a cylinder air charge $M_{ac}$ and derive coefficients for a second linear function $G_l$ for estimating a magnitude of engine torque ($T_E$) during vehicle development or pre-production. In one embodiment the derived coefficients for the first and second linear functions $F_l$ and $G_l$ are promulgated in control modules for production copies of the engine 10 that are not equipped with the torque sensor 20, and used to estimate a magnitude of the cylinder air charge $M_{ac}$ and a magnitude of the engine torque $T_E$ during ongoing operation of all the production copies of the engine 10. In an alternate embodiment representative production copies of the engine 10 may be equipped with the torque sensor 20, with coefficients for the first and second linear functions $F_l$ and $G_l$ being derived during ongoing operation of each individual production copy of the engine 10. The first and second linear functions $F_l$ and $G_l$ are used to estimate a magnitude of a cylinder air charge $M_{ac}$ and a magnitude of engine torque $T_E$ on the individual production copies of the engine 10 that are equipped with the torque sensor 20.

It is appreciated that states of control and operating parameters of the engine 10 are monitored, estimated or otherwise determined, including, e.g., throttle angle, intake and exhaust cam phaser positions, intake and exhaust manifold pressures and temperatures, spark advance, fuel injection timing, and throttle mass airflow rate, from which the control module 50 is able to calculate, estimate, or otherwise determine states of engine operating parameters.

The engine 10 includes a plurality of actuators, each of which is controllable to an operating state to operate the engine 10 in response to operator commands, ambient conditions, and system constraints. Controllable engine actuators may include, e.g., fuel injectors, EGR valves, throttle valves, variable cam phasing devices, variable engine valve lift devices, camless valve actuators, turbochargers, and spark ignition systems on engines so equipped.

Engine operation includes engine torque monitoring using the torque sensor 20, whereby measurements are taken corresponding to each tooth passing on the crank wheel 19. The control module 50 executes instruction sets to command states of engine control parameters. This includes controlling states of the aforementioned actuators including throttle position, fuel injection mass and timing, EGR valve position to control flow of recirculated exhaust gases, spark-ignition timing or glow-plug operation, and control of intake and/or exhaust valve timing, phasing, and lift, on systems so equipped.

The control module 50 is configured to monitor engine operating states and control engine operation by commanding states of engine control parameters during ongoing engine operation. Control module, module, controller, control unit, processor and similar terms mean any suitable one or various combinations of one or more of Application Specific Integrated Circuit(s) (ASIC), electronic circuit(s), central processing unit(s) (preferably microprocessor(s)) and associated memory and storage (read only, programmable read only, random access, hard drive, etc.) executing one or more software or firmware programs, combinational logic circuit(s), input/output circuit(s) and devices, appropriate signal conditioning and buffer circuitry, and other suitable components to provide the described functionality. The control module 50 has a set of control algorithms, including resident software program instructions and calibrations stored in memory and executed to provide the desired functions. The algorithms are preferably executed during preset loop cycles. Algorithms are executed, such as by a central processing unit, and are operable to monitor inputs from sensing devices and other networked control modules, and execute control and diagnostic routines to control operation of actuators. Loop cycles may be executed at regular intervals, for example each 0.1, 1.0, 3.125, 6.25, 12.5, 25 and 100 milliseconds during ongoing engine and vehicle operation. Alternatively, algorithms may be executed in response to occurrence of an event.

Figure 2:
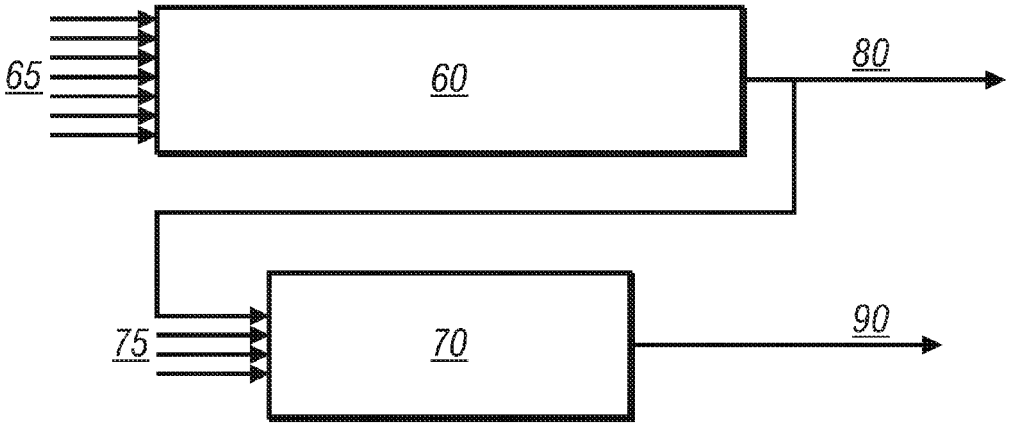
FIG. 2 is a schematic block diagram for estimating a mass air charge for each cylinder event, in accordance with the present disclosure.

FIG. 2 is a schematic block diagram depicting a relationship between states of engine control and operating parameters including a mass air charge for a cylinder event $M_{ac}$ (80) and engine torque $T_E$ (90) during operation of an internal combustion engine, e.g., the internal combustion engine 10 configured as described with reference to FIG. 1. The relationship may be described in terms of the first linear function $F_l$ (60) and the second linear function $G_l$ (70).

The first linear function $F_l$ (60) is a linear equation that is used to estimate a magnitude of a cylinder air charge $M_{ac}$ (80) using a plurality of engine input parameters (65), as follows.

$$M_{ac} = F_l\left(\begin{array}{c}\alpha_{th}, \alpha_{ci}, \alpha_{co}, P_m, P_mN, \frac{1}{\sqrt{T_M}}, \frac{P_m}{\sqrt{T_m}}, \frac{P_mN}{\sqrt{T_m}}, \\ \frac{P_m^2N}{\sqrt{T_m}}, \frac{P_mN^2}{\sqrt{T_m}}, M_{af}, M_{af}N, \frac{T_m}{T_e}, \left(\frac{N}{T_m}\right)^{0.8}, \\ \frac{P_eN}{P_m}, \frac{N^2}{T_m}\left(\frac{T_m}{P_e} + (cr-1)\right)\end{array}\right) \quad [1]$$

The engine input parameters (65) are calculated using states of selected engine control and operating parameters that are monitored, estimated, or otherwise determined. The engine input parameters include the following.

$a_{th}$ Throttle angle
$a_{ci}$, $a_{co}$ Intake and exhaust cam phaser positions
$P_e$ Exhaust pressure
$T_e$ Exhaust temperature
$P_m$ Intake manifold pressure
$T_m$ Intake manifold temperature
$M_{af}$ Mass airflow (at throttle)
cr Compression ratio
N Engine speed The first linear function $F_l$ (60) may be reduced to estimate cylinder air mass, written algebraically as follows:

$$\begin{aligned} M_{ac} = {} & a_1 * P_m + a_2 * P_mN + a_3 * \frac{P_m}{\sqrt{T_m}} + a_4 * \frac{P_mN}{\sqrt{T_m}} + \\ & a_5 * \frac{P_m^2N}{\sqrt{T_m}} + a_6 * \frac{P_mN^2}{\sqrt{T_m}} + a_7 * M_{af} + a_8 * M_{af}N + \\ & a_9 * \alpha_{th} + a_{10} * \left(\frac{N}{T_m}\right) + a_{11} * \frac{P_eN}{P_m} + a_{12} * \frac{N^2}{T_m}\left(\frac{T_m}{T_e} + (cr-1)\right) \end{aligned} \quad [2]$$

wherein the terms $a_1$-$a_{12}$ are coefficients that are derived for a specific powertrain application. The coefficients $a_1$-$a_{12}$ may be derived on a representative copy of the engine 10 during calibration and promulgated across production copies of the engine 10. Alternatively the coefficients $a_1$-$a_{12}$ may be derived on each production copy of the engine 10.

The second linear function $G_l$ (70) is a linear equation that is used to estimate a magnitude of engine torque $T_E$ (90) using the cylinder air charge $M_{ac}$ (80) and a plurality of monitored and estimated states for engine operating parameters (75) as follows:

$$T_E = G_l(M_{ac}, AF, \delta, N) \quad [3]$$

wherein AF is air/fuel ratio,
δ is spark angle (or start of injection on a compression-ignition engine), and
N is engine speed.

The second linear function $G_l$ (70) may be written algebraically as follows:

$$\begin{aligned} T_E(k) = {} & \hat{\theta}_0 + \hat{\theta}_1 M_{ac}(k-d_{ac}) + \hat{\theta}_2 AF(k-d_{af}) + \\ & \hat{\theta}_3 AF^2(k-d_{af}) + \hat{\theta}_4 \delta(k-d_{sa}) + \hat{\theta}_5 \delta^2(k-d_{sa}) + \\ & \hat{\theta}_6 \delta(k-d_{sa})N(k) + \hat{\theta}_7 \delta(k-d_{sa})N^2(k) + \hat{\theta}_8 N(k) + \hat{\theta}_9 N^2(k) \end{aligned} \quad [4]$$

wherein k represents an individual cylinder event, incremented in a stepwise manner with advancing cylinder events. The magnitude of engine torque $T_E$ is an average or maximum engine torque for the individual cylinder event k. The terms $d_{ac}$, $d_{sa}$, and $d_{af}$ are time delay parameters, with $d_{ac}$ being a delay between a measurement in the mass air charge and a corresponding effect on engine torque, $d_{sa}$ being a time delay between a change in timing of a spark event and a corresponding effect on engine torque, and $d_{af}$ being a delay between torque measurement and measured air/fuel ratio, with each of the time delay parameters preferably measured in terms of discrete cylinder events. The terms $\hat{\theta}_0$-$\hat{\theta}_9$ are coefficients that are derived for a specific powertrain application. The coefficients $\hat{\theta}_0$-$\hat{\theta}_9$ and time delay parameters $d_{ac}$, $d_{sa}$, and $d_{af}$ may be derived on a representative copy of the engine 10 during calibration and promulgated across production copies of the engine 10. Alternatively the coefficients $\hat{\theta}_0$-$\hat{\theta}_9$ and time delay parameters $d_{ac}$, $d_{sa}$, and $d_{af}$ may be derived on each production copy of the engine 10. Nominal values for the time delay parameters include $d_{ac}$ equal to 4 cylinder events, $d_{sa}$ equal to 1 cylinder event and $d_{af}$ equal to 12 cylinder events.

Figure 3:
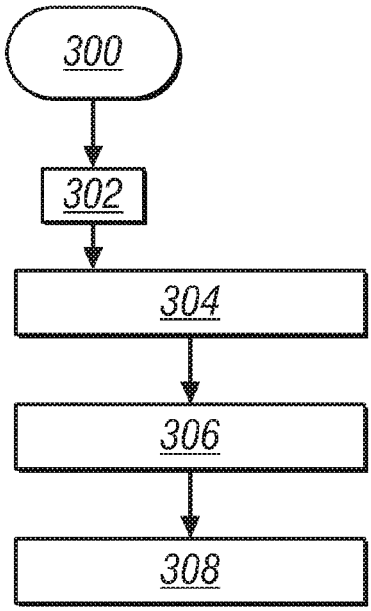
FIG. 3 is a flowchart of a process for estimating engine torque when a magnitude of the cylinder air charge is known, in accordance with the present disclosure.
Figure 4:
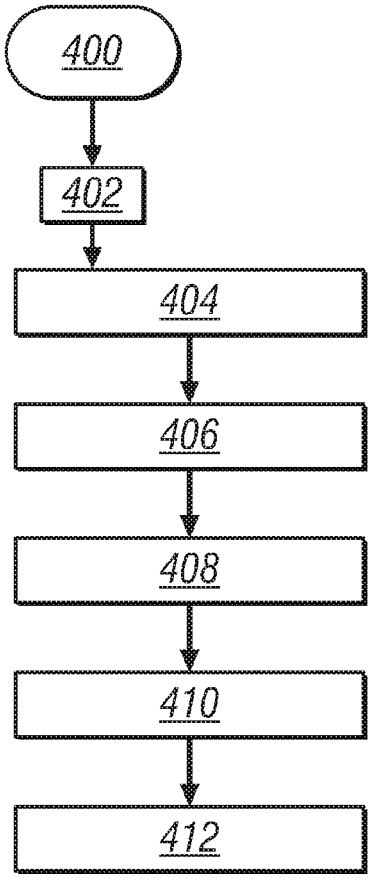
FIG. 4 is a flowchart of a process for simultaneously estimating engine torque and a magnitude of the cylinder air charge, in accordance with the present disclosure.

A process described with reference to FIGS. 3 and 4 is used to estimate a cylinder air charge $M_{ac}$ at time event k, and derive an associated engine torque model for an exemplary engine equipped as described with reference to FIG. 1 using the first and second linear functions $F_l$ (60) and $G_l$ (70) and the associated equations above. Coefficients for the first and second linear functions $F_l$ (60) and $G_l$ (70), i.e., $a_1$-$a_{12}$ and $\hat{\theta}_0$-$\hat{\theta}_9$ are derived from experimental data.

When the coefficients $a_1$-$a_{12}$ and $\hat{\theta}_0$-$\hat{\theta}_9$ are known, the cylinder air charge at cylinder event k, written as $M_{ac}(k)$ may be estimated as follows using the first and second linear functions $F_l$ (60) and $G_l$ (70):

$$M_{ac}(k) = \frac{1}{\theta_1}\begin{pmatrix} -T_E(k+d_{ac}) + \theta_0 + \theta_2 * AF(k-d_{af}+d_{ac}) + \\ \theta_3 * AF^2(k-d_{af}+d_{ac}) + \theta_4 * \delta(k-d_{sa}+d_{ac}) + \\ \theta_5 * \delta^2(k-d_{sa}+d_{ac}) + \theta_6 * \delta(k-d_{sa}+d_{ac}) \\ N(k+d_{ac}) + \theta_7 * \delta(k-d_{sa}+d_{ac}) \\ N^2(k+d_{ac}) + \theta_8 * N(k+d_{ac}) + \theta_9 * N^2(k+d_{ac}) \end{pmatrix} \quad [5]$$

wherein $\hat{\theta}_0$-$\hat{\theta}_9$ are coefficients derived using the second linear function $G_l$ (70) and associated coefficients $a_1$-$a_{12}$ for a specific engine application. The process to estimate a cylinder air charge $M_{ac}$ includes operating an engine, e.g., the engine 10 described with reference to FIG. 1, and monitoring states of the operating and control parameters described with reference to the first linear function $F_l$. Monitored states of control parameters preferably include control states for engine actuators, e.g., throttle angle, intake and exhaust cam phaser positions, spark advance, and fuel injection timing, among others. Monitored states of operating parameters include engine speed, throttle mass airflow rate, engine torque, intake and exhaust manifold pressures and temperatures, and exhaust air-fuel ratio, among others.

The monitored states for the operating and control parameters are used to determine best fit states for the time delay parameters of $d_{ac}$, $d_{sa}$, and $d_{af}$ using standard correlation techniques or direct optimization. Similarly, monitored states for the operating and control parameters are analyzed using standard or modified least squares identification techniques to derive the coefficients for the first and second linear functions $F_l$ (60) and $G_l$ (70), i.e., $a_1$-$a_{12}$ and $\hat{\theta}_0$-$\hat{\theta}_9$.

Thus, the first linear function $F_l$ (60) may be executed with the derived coefficients $a_1$-$a_{12}$ to calculate a cylinder air charge $M_{ac}$ for each cylinder event in real time, i.e., during ongoing engine operation, with the calculated cylinder air charge $M_{ac}$ corresponding to the states of the monitored input and output parameters. Similarly, the monitored states of the input and output parameters may be used to calculate the engine torque $T_E$. It is appreciated that assumptions may be made for exhaust pressure and exhaust temperature when such sensors are not available. It is also appreciated that when an engine is configured to operate using a closed-loop control scheme with a stoichiometric air/fuel ratio sensor, the air/fuel ratio may be approximated at stoichiometric value of 14.65:1.

When the coefficients $\hat{\theta}_0$-$\hat{\theta}_9$ for the second linear function $G_l$ have been derived, the relationship described with reference to EQ. 4 may be used to determine a magnitude of the cylinder air charge $M_{ac}$ in real time when the torque sensor 20 is available. The magnitude of the cylinder air charge $M_{ac}$ corresponds to a magnitude of engine torque as measured with the torque sensor 20 for the exemplary engine 10 when monitored states for parameters including the air/fuel ratio (AF), spark angle (δ) (or start of fuel injection on a compression-ignition engine), and engine speed (N) are known.

Thus, it is appreciated that an exemplary engine may be configured with a plurality of sensors and other monitoring devices, including the high-resolution torque sensor 20 described with reference to FIG. 1. The engine may be subjected to a range of speed/load operating points with states of selected engine control and operating parameters that are monitored, estimated, or otherwise determined. States for parameters including the air/fuel ratio AF, spark angle δ (or start of fuel injection on a compression-ignition engine), and engine speed N are simultaneously monitored. States of time delay parameters $d_{ac}$, $d_{sa}$, and $d_{af}$ are determined. The engine input parameters for the first linear function $F_l$ (60) described with reference to EQS. 1 and 2 may be determined. Similarly, engine torque $T_E$ may be estimated using the second linear function $G_l$ (70) described in EQS. 3 and 4, with measured torque for a cylinder event T(k) used to estimate the coefficients $a_1$-$a_{12}$ for the first linear function $F_l$ (60) and the coefficients $\hat{\theta}_0$-$\hat{\theta}_9$ for the second linear function $G_l$ (70). EQS. 2 and 4 with associated coefficients may be reduced to executable code or instructions in a control module for an engine system to simultaneously estimate a mass air charge for a cylinder event $M_{ac}$ and engine torque $T_E$ during ongoing engine operation without using an on-vehicle torque sensor.

Similarly, the relation described with reference to EQ. 5 may be executed to determine mass air charge for a cylinder event $M_{ac}(k)$ on an exemplary engine equipped with the torque sensor 20 using the aforementioned monitored engine parameters.

FIG. 3 is a flowchart 300 depicting a process for estimating engine torque when a magnitude of the cylinder air charge $M_{ac}$ is known. During operation of a representative copy of the engine 10, engine operating and control parameters associated with engine input parameters are monitored, including monitoring engine rotational speed N, air/fuel ratio AF, and timing of initiation of a spark ignition event δ for a cylinder event (302). Time delay parameters $d_{ac}$, $d_{sa}$, and $d_{af}$ are determined using correlations and optimizations, as described herein (304). A magnitude of a cylinder air charge $M_{ac}$ is estimated and recorded at various operating conditions (306), with those operating conditions represented by engine operating and control parameters associated with the first linear function $F_l$ (60) including the following.

$a_{th}$ Throttle angle
$a_{ci}$, $a_{co}$ Intake and exhaust cam phaser positions
$P_e$ Exhaust pressure
$T_e$ Exhaust temperature
$P_m$ Intake manifold pressure
$T_m$ Intake manifold temperature
$M_{af}$ Mass airflow (at throttle)
cr Compression ratio
N Engine speed A magnitude of torque for the operating conditions associated with an individual cylinder event k is estimated using the second linear function $G_l$, described with reference to EQ. 4, above, using the engine operating and control parameters associated with engine input parameters and the engine operating and control parameters associated with the first linear function $F_l$ (60) (308).

FIG. 4 is a flowchart 400 depicting a process for simultaneously estimating engine torque for a cylinder event T(k) and a magnitude of the cylinder air charge $M_{ac}$ for the cylinder event. During operation of a representative copy of the engine 10, engine operating and control parameters associated with engine input parameters are monitored, including monitoring engine rotational speed N, air/fuel ratio AF, and timing of initiation of a spark ignition event δ for a cylinder event (402). Time delay parameters $d_{ac}$, $d_{sa}$, and $d_{af}$ are determined using correlations and optimizations, as described herein (404). Operating conditions represented by engine operating and control parameters associated with the first linear function $F_l$ (60) for determining a magnitude of the cylinder air charge $M_{ac}$ are estimated or otherwise determined and recorded at various operating conditions (406), including the following.

$a_{th}$ Throttle angle
$a_{ci}$, $a_{co}$ Intake and exhaust cam phaser positions
$P_e$ Exhaust pressure
$T_e$ Exhaust temperature
$P_m$ Intake manifold pressure
$T_m$ Intake manifold temperature
$M_{af}$ Mass airflow (at throttle)
cr Compression ratio
N Engine speed The first linear function $F_l$ (60) may be executed to estimate the magnitude of the cylinder air charge $M_{ac}$ under specific operating conditions (408). The torque at cylinder event k, i.e., T(k), may be determined using the second linear function $G_l$ (70).

This includes monitoring engine operation under steady-state conditions, e.g., an engine idle or a cruise condition to estimate a magnitude of the cylinder air charge $M_{ac}$, as follows.

$$M_{ac} = 15\left(\frac{M_{af}}{N}\right) \quad [6]$$

This relationship may be used to estimate $\theta_1$ for the second linear function $G_l$ (70). Then, under more general operating conditions, the monitored torque T(k) for the cylinder event may be used to estimate the coefficients $a_1$-$a_{12}$ for the first linear function $F_l$ (60) and the coefficients $\theta_0$-$\theta_9$ for the second linear function $G_l$ (70) (410). The first and second linear functions $F_l$ (60) and $G_l$ (70) as described using EQS. 2 and 4 may be executed for each cylinder event to determine a magnitude of engine torque T(k) and a magnitude of the cylinder air charge $M_{ac}$(k) for the cylinder event (412).

Thus, in an operating environment wherein a representative copy of the engine 10 is equipped with the torque sensor 20 during a calibration exercise to derive coefficients for the first and second linear functions $F_l$ (60) and $G_l$ (70), a magnitude of engine torque T(k) and a magnitude of the cylinder air charge $M_{ac}$(k) for a cylinder event may be estimated and used for engine control during ongoing operation.

Furthermore, in an operating environment wherein production copies of the engine 10 are equipped with the torque sensor 20 during ongoing operation, coefficients for the first and second linear functions $F_l$ (60) and $G_l$ (70) may be derived, and a magnitude of engine torque T(k) for a cylinder event measured using the torque sensor 20 may be used to estimate a magnitude of the cylinder air charge $M_{ac}$(k) for the cylinder event during ongoing operation.

The magnitude of engine torque T(k) and the magnitude of the cylinder air charge $M_{ac}$(k) for a cylinder event may be used for engine control to manage emissions, execute torque-based engine diagnostics routines, and provide ongoing, real-time adaptation on individual engine systems during engine life. Use of the torque sensor 20 facilitates in-vehicle engine calibration of representative engines. Use of the torque sensor 20 to determine magnitude of engine torque T(k) for a cylinder event facilitates engine and powertrain torque-based control schemes that are responsive to operator torque requests, including hybrid powertrain systems wherein torque demands are met using engine-generated torque and torque generated from other sources, e.g., electric motors. Use of the torque sensor 20 may be used in compression-ignition engines, including engines operating using diesel fuel-based engine control schemes and spark-ignition engines operating under homogeneous-charge compression ignition control schemes or lean-burn control schemes.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. Method for operating an internal combustion engine, comprising:

monitoring signal output from a high-resolution torque sensor configured to monitor engine torque during ongoing operation;

monitoring states of engine operating and control parameters associated with engine input parameters comprising engine rotational speed, air/fuel ratio, and timing of initiation of a spark ignition event for the cylinder event;

estimating a plurality of time delays including a time delay between the estimated mass air charge for a cylinder event and a corresponding effect on engine torque, a time delay between change in initiation of the spark ignition event and a corresponding effect on engine torque, and a time delay between measured torque and a corresponding effect on air/fuel ratio; and estimating a mass air charge for each cylinder event corresponding to the signal output from the high-resolution torque sensor, the engine rotational speed, the air/fuel ratio, the timing of initiation of a spark ignition event for the cylinder event, and the estimated time delays.

2. The method of claim 1, further comprising controlling mass of engine fuel for each cylinder event in response to the estimated mass air charge for each cylinder event.

3. The method of claim 1, comprising:

monitoring states of engine operating and control parameters associated with the engine input parameters and engine output parameters;

deriving coefficients for a first linear function using the states of the engine operating and control parameters associated with the engine input parameters and the engine output parameters; and executing the first linear function to estimate the mass air charge for each cylinder event.

4. The method of claim 3, comprising monitoring states of engine operating parameters associated with engine rotational speed, air/fuel ratio, and a timing of initiation of a spark ignition event for a cylinder event;

deriving coefficients for a second linear function using the monitored states of engine operating parameters associated with engine rotational speed, air/fuel ratio, and timing of initiation of a spark ignition event for a cylinder event; and executing the first linear function to estimate the mass air charge for each cylinder event.

5. The method of claim 1, further comprising deriving coefficients for a first linear function for estimating a mass air charge corresponding to the monitored states of engine operating and control parameters associated with the engine input parameters;

deriving coefficients for a second linear function for estimating a magnitude of engine torque corresponding to the estimated mass air charge for the cylinder event;

monitoring engine rotational speed, air/fuel ratio, and timing of initiation of a spark ignition event for the cylinder event;

determining a magnitude of engine torque associated with a cylinder event corresponding to the signal output from the high-resolution torque sensor;

using the first and second linear functions to estimate a mass air charge for the cylinder event corresponding to the magnitude of engine torque, the engine rotational speed, the air/fuel ratio, and the timing of initiation of the spark ignition event for the cylinder event.

6. A method for operating an internal combustion engine, comprising:

monitoring states of engine operating and control parameters associated with engine input parameters and engine output parameters and a corresponding engine torque; and deriving coefficients for first and second linear function equations based upon the monitored states of engine operating and control parameters associated with engine input parameters and engine output parameters and the corresponding engine torque; and then monitoring states of the engine operating and control parameters associated with the engine input parameters and the engine output parameters;

executing the first linear function using the derived coefficients for the first linear function equation to estimate a mass air charge for each cylinder event; and executing the second linear function using the derived coefficients for the second linear function equation to estimate engine torque;

wherein deriving coefficients for the first and second linear function equations based upon the monitored states of engine operating and control parameters associated with engine input parameters and engine output parameters and the corresponding engine torque includes estimating a plurality of time delays, the plurality of time delays including a time delay between the estimated mass air charge for a cylinder event and a corresponding effect on engine torque, a time delay between change in initiation of the spark ignition event and a corresponding effect on engine torque, and a time delay between measured torque and a corresponding effect on air/fuel ratio.

7. The method of claim 6, further comprising:

monitoring signal output from a high-resolution torque sensor configured to monitor the engine torque during ongoing engine operation; and executing the first linear function using the derived coefficients for the first linear function equation and the engine torque to estimate a mass air charge for each cylinder event.

8. The method of claim 6, wherein executing the second linear function using the derived coefficients for the second linear function equation to estimate engine torque includes executing the second linear function using the derived coefficients for the second linear function equation including the plurality of time delays to estimate engine torque for each cylinder event.

9. A method for operating an internal combustion engine, comprising:

monitoring states of engine operating and control parameters associated with engine input parameters and engine output parameters and a corresponding engine torque;

deriving coefficients for first and second linear function equations based upon the monitored states of engine operating and control parameters associated with engine input parameters and engine output parameters and the corresponding engine torque; and then monitoring states engine rotational speed, air/fuel ratio, and timing of initiation of a spark ignition event associated with a cylinder event;

executing the first linear function using the derived coefficients for the first linear function equation and the monitored states for engine rotational speed, air/fuel ratio, and timing of initiation of a spark ignition event for the cylinder event to estimate a cylinder air charge for the cylinder event; and executing the second linear function using the derived coefficients for the second linear function equation and the monitored states for engine rotational speed, air/fuel ratio, and timing of initiation of a spark ignition event for the cylinder event to estimate engine torque for the cylinder event;

wherein deriving coefficients for the first and second linear function equations based upon the monitored states of engine operating and control parameters associated with engine input parameters and engine output parameters and the corresponding engine torque includes estimating a plurality of time delays, the plurality of time delays including a time delay between the estimated mass air charge for a cylinder event and a corresponding effect on engine torque, a time delay between change in initiation of the spark ignition event and a corresponding effect on engine torque, and a time delay between measured torque and a corresponding effect on air/fuel ratio.

10. The method of claim 9 , further comprising:

monitoring signal output from a high-resolution torque sensor configured to monitor the engine torque during ongoing engine operation; and executing the first linear function using the derived coefficients for the first linear function equation and the monitored states for engine rotational speed, air/fuel ratio, and timing of initiation of a spark ignition event for the cylinder event and the signal output from the high-resolution torque sensor to estimate the cylinder air charge for the cylinder event.

11. The method of claim 9, wherein executing the second linear function using the derived coefficients for the second linear function equation and the monitored states for engine rotational speed, air/fuel ratio, and timing of initiation of a spark ignition event for the cylinder event to estimate engine torque for the cylinder event comprises executing the second linear function using the derived coefficients for the second linear function equation and the monitored states for engine rotational speed, air/fuel ratio, the timing of initiation of a spark ignition event for the cylinder event, and the plurality of time delays to estimate engine torque for the cylinder event.

* * * * *